US009198493B2

(12) United States Patent
Hall

(10) Patent No.: US 9,198,493 B2
(45) Date of Patent: Dec. 1, 2015

(54) DEVICE FOR MAINTAINING DREADLOCKS

(71) Applicant: Cynthia Hall, Norfolk, VA (US)

(72) Inventor: Cynthia Hall, Norfolk, VA (US)

( * ) Notice: Subject to any disclaimer, the term of this patent is extended or adjusted under 35 U.S.C. 154(b) by 0 days.

(21) Appl. No.: 14/222,962

(22) Filed: Mar. 24, 2014

(65) Prior Publication Data

US 2014/0283390 A1 Sep. 25, 2014

Related U.S. Application Data

(60) Provisional application No. 61/804,838, filed on Mar. 25, 2013.

(51) Int. Cl.

| | |
|---|---|
| ***A45D 2/00*** | (2006.01) |
| ***B26B 19/00*** | (2006.01) |
| ***B26B 21/40*** | (2006.01) |
| *A45D 6/02* | (2006.01) |

(52) U.S. Cl.

CPC . *A45D 2/00* (2013.01); *B26B 19/00* (2013.01); *B26B 21/4081* (2013.01); *A45D 6/02* (2013.01); *A45D 2002/006* (2013.01)

(58) Field of Classification Search

CPC ..... A45D 2/00; A45D 19/02; A45D 7/04; A45D 19/18; A45D 19/00; A45D 6/04; A45D 6/02; A45D 2/06; A45D 1/04; A45D 2/32; B26B 9/00; B26B 21/4081

See application file for complete search history.

(56) References Cited

U.S. PATENT DOCUMENTS

| | | | | |
|---|---|---|---|---|
| 2,935,070 | A * | 5/1960 | Auz | 132/229 |
| 4,580,585 | A | 4/1986 | Sapkus | |
| 4,824,036 | A * | 4/1989 | Buta | 242/442 |
| 5,783,800 | A | 7/1998 | Thompson et al. | |
| 6,318,378 | B1 * | 11/2001 | Kennedy et al. | 132/212 |
| 6,575,175 | B2 * | 6/2003 | Kim et al. | 132/210 |
| 6,708,699 | B2 | 3/2004 | McGriff, III | |
| 6,962,159 | B1 * | 11/2005 | Adam | 132/210 |
| 7,073,516 | B1 | 7/2006 | Beamen | |
| 2002/0189629 | A1 | 12/2002 | McGriff, III | |
| 2004/0216758 | A1 * | 11/2004 | Rascoe | 132/200 |
| 2005/0241663 | A1 * | 11/2005 | Getahun | 132/272 |
| 2008/0149130 | A1 | 6/2008 | Brown | |
| 2010/0006117 | A1 | 1/2010 | Gutierrez | |
| 2012/0325262 | A1 * | 12/2012 | Sansole et al. | 132/210 |

* cited by examiner

*Primary Examiner* — Robyn Doan

(74) *Attorney, Agent, or Firm* — Buckingham, Doolittle & Burroughs, LLC

(57) ABSTRACT

A device for maintaining a lock of hair such as a dreadlock is provided. The device comprises a housing encasing a motor activated by a controller. A grooming element for encasing the dreadlock is rotatably situated within the housing. The housing comprises a clamping mechanism for securing the device to the dreadlock. Once the dreadlock is secured by the clamping mechanism, the grooming element rotates around the dreadlock to integrate new hair growth into the dreadlock. The grooming element comprises a plurality of trimming components for removing any excess hair that did not integrate into the dreadlock.

13 Claims, 5 Drawing Sheets

DEVICE FOR MAINTAINING DREADLOCKS

CROSS-REFERENCE

This application claims priority from Provisional Patent Application Ser. No. 61/804,838 filed Mar. 25, 2013.

FIELD OF THE INVENTION

This invention pertains generally to a device for maintaining and grooming dreadlocks, and more particularly to a device for twisting new hair growth around an existing dreadlock and trimming excess hair from the dreadlock.

BACKGROUND

Dreadlocks are a hairstyle wherein long hairs form into matted twisted coils or ropes of hair. Traditional dreadlocks typically form naturally and can vary widely in size and diameter creating an unkempt appearance. Hair stylists can create more evenly sectioned dreadlocks with a neater appearance. However, keeping dreadlocks maintained neatly can be time consuming, frustrating, and even physically strenuous. It can take several hours to twist a full head of hair into dreadlocks during routine maintenance. Individuals working on the hair can suffer from tendonitis, arthritis, or carpel tunnel syndrome as a result of the frequent intense twisting motions associated with dreadlock grooming.

Consequently, there exists a need for a device that can maintain neat and uniform dreadlocks. The present invention discloses a device for grooming and refreshing dreadlocks with a minimal amount of time and effort. The device allows a user to twist new hair growth around an existing dreadlock and trim any excess hair along the shaft of the lock without the need for manual twisting that can lead to tendonitis, arthritis, carpel tunnel syndrome, or other repetitive motion injuries.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a device for grooming a dreadlock by twisting new hair growth around the dreadlock and then trimming any excess hairs along a shaft of the dreadlock once the twisting is complete. The apparatus comprises a housing bisected along a length of the housing encasing a motor activated by a controller element for engaging a grooming element rotatably situated within the housing. The grooming element encases the dreadlock and is rotated through several revolutions thereby integrating the new hair growth into the existing dreadlock. Once the new hair growth is integrated into the dreadlock, the device is slid downward along the shaft of the dreadlock thereby trimming any excess hair that did not integrate into the dreadlock. The process is repeated on additional dreadlocks so that all dreadlocks are maintained with a neat and uniform appearance.

Furthermore, in a preferred embodiment of the invention, the housing comprises a clamping mechanism for engaging the dreadlock. After the device is positioned around and substantially encapsulates the dreadlock, the clamping mechanism locks onto the dreadlock to keep the shaft of the dreadlock from rotating once the device is engaged. Once the device is locked onto the dreadlock, the grooming element spins wrapping and integrating the new hair growth into the dreadlock. The grooming element comprises a plurality of trimming elements embedded within an inner circumference of the grooming element for trimming any excess hair that could not be integrated. Once the rotation of the grooming element is stopped, the clamping mechanism is released. The user then slides the device down the dreadlock allowing the plurality of trimming elements to cut off and remove the excess portion of any hairs that would not stay wrapped.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
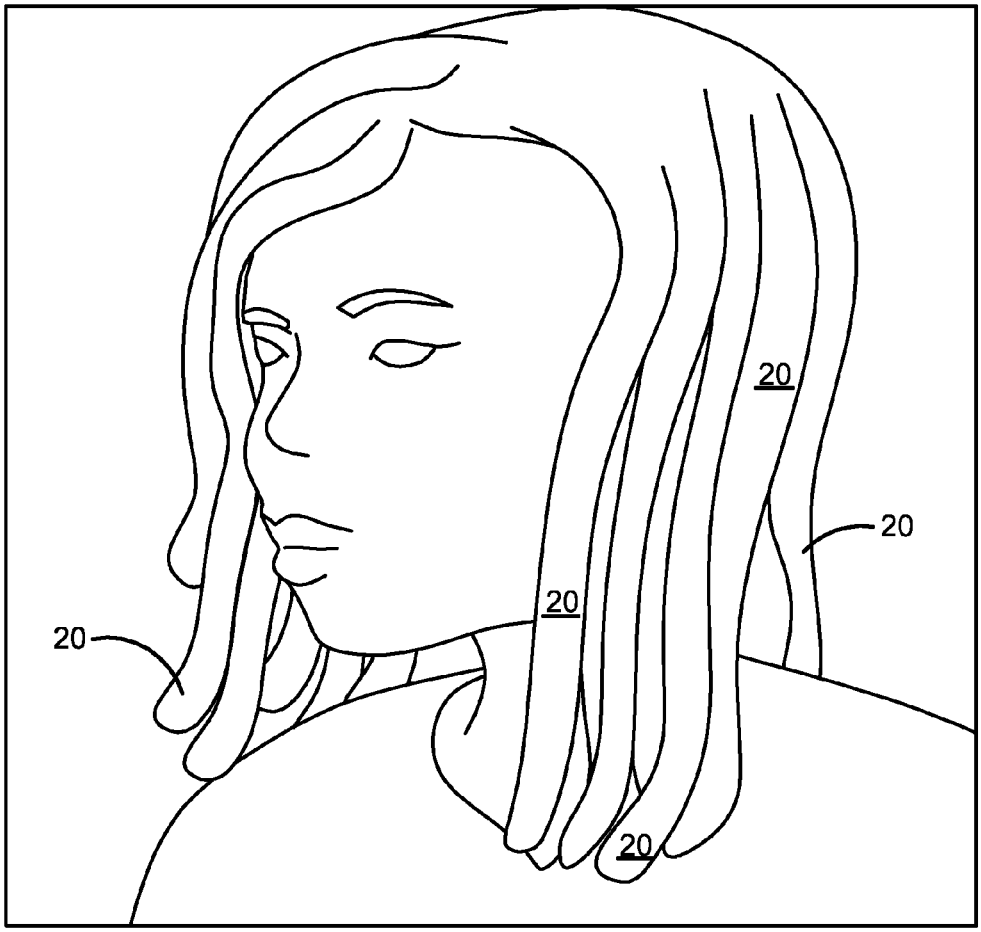
FIG. 1 illustrates a perspective view of a plurality of locks of hair in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to a device for maintaining a lock of twisted, matted, or coiled hair such as a dreadlock.

Referring initially to the drawings, FIGS. 1-5 illustrate a device 100 for maintaining a lock of hair 20. The lock of hair 20 to be maintained is typically a dreadlock, however it is contemplated that the device 100 may be used to maintain any lock of hair that is twisted, braided, woven, coiled, matted, and the like without affecting the overall scope of the invention. The device comprises a housing 102, a motor 122, a controller element 128, and a grooming element 134.

The housing 102 is typically a shell that is plastic in composition, although it is contemplated that the composition of the housing 102 may comprise a variety of materials, such as metal, polymers, alloys, and the like without affecting the overall scope of the invention. The housing 102 is generally cylindrical in configuration and approximately between four and eight inched in length. The housing 102 has a circumference of approximately between two and four inches. The dimension of the circumference will depend on a diameter of the lock of hair 20 to be maintained. The inventor contemplates embodiments of the device 100 comprising several different circumferences to accommodate locks of hair having different diameters. For example, if the dreadlock is between approximately ¼ and ½ inches in diameter, a housing with a smaller circumference would be used. Similarly, a larger circumference housing would be used for a dreadlock approximately between ¾ and one inches in diameter.

Figure 2:
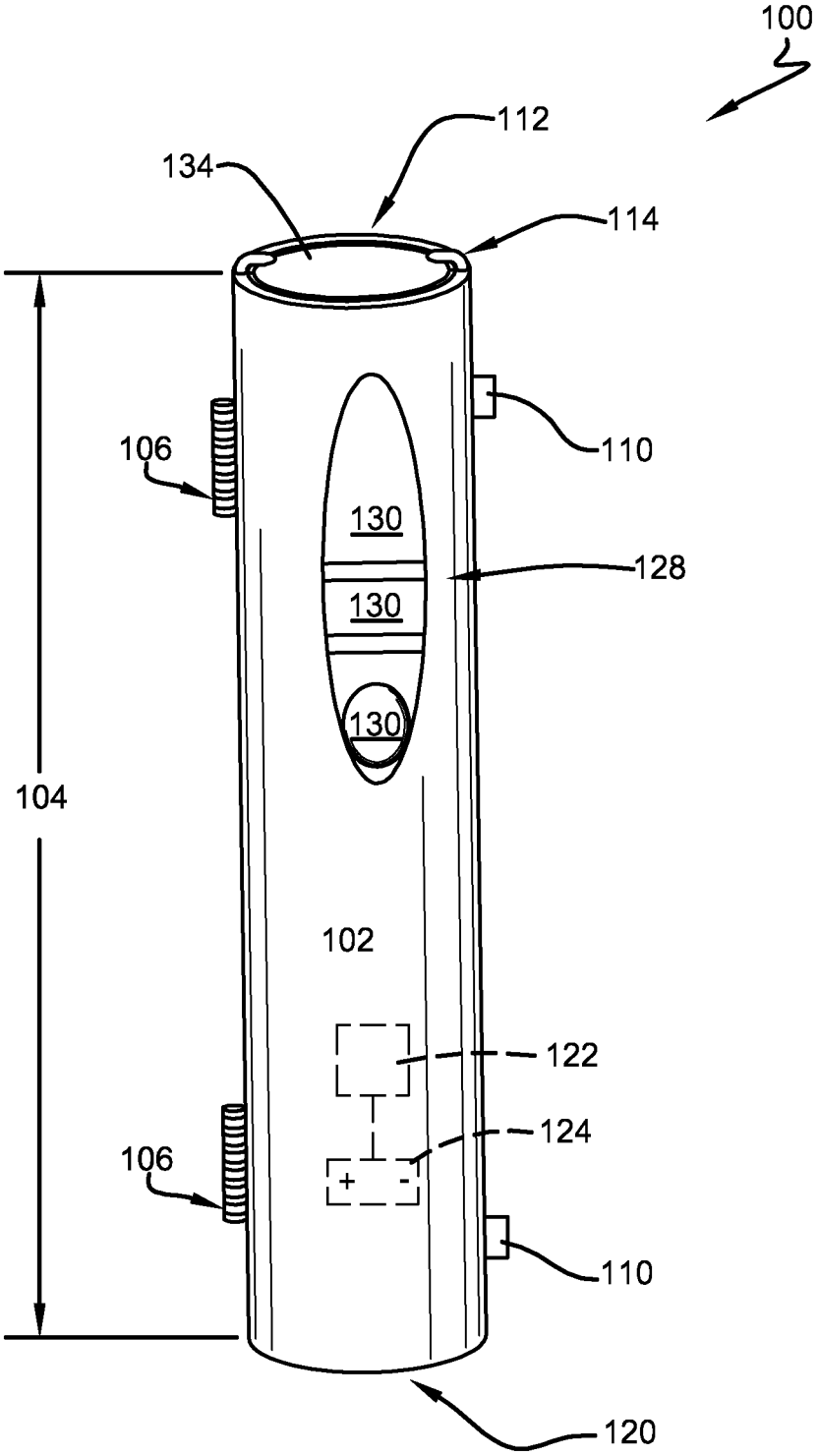
FIG. 2 illustrates a perspective view of a device for maintaining a lock of hair in accordance with the disclosed architecture.
Figure 3:
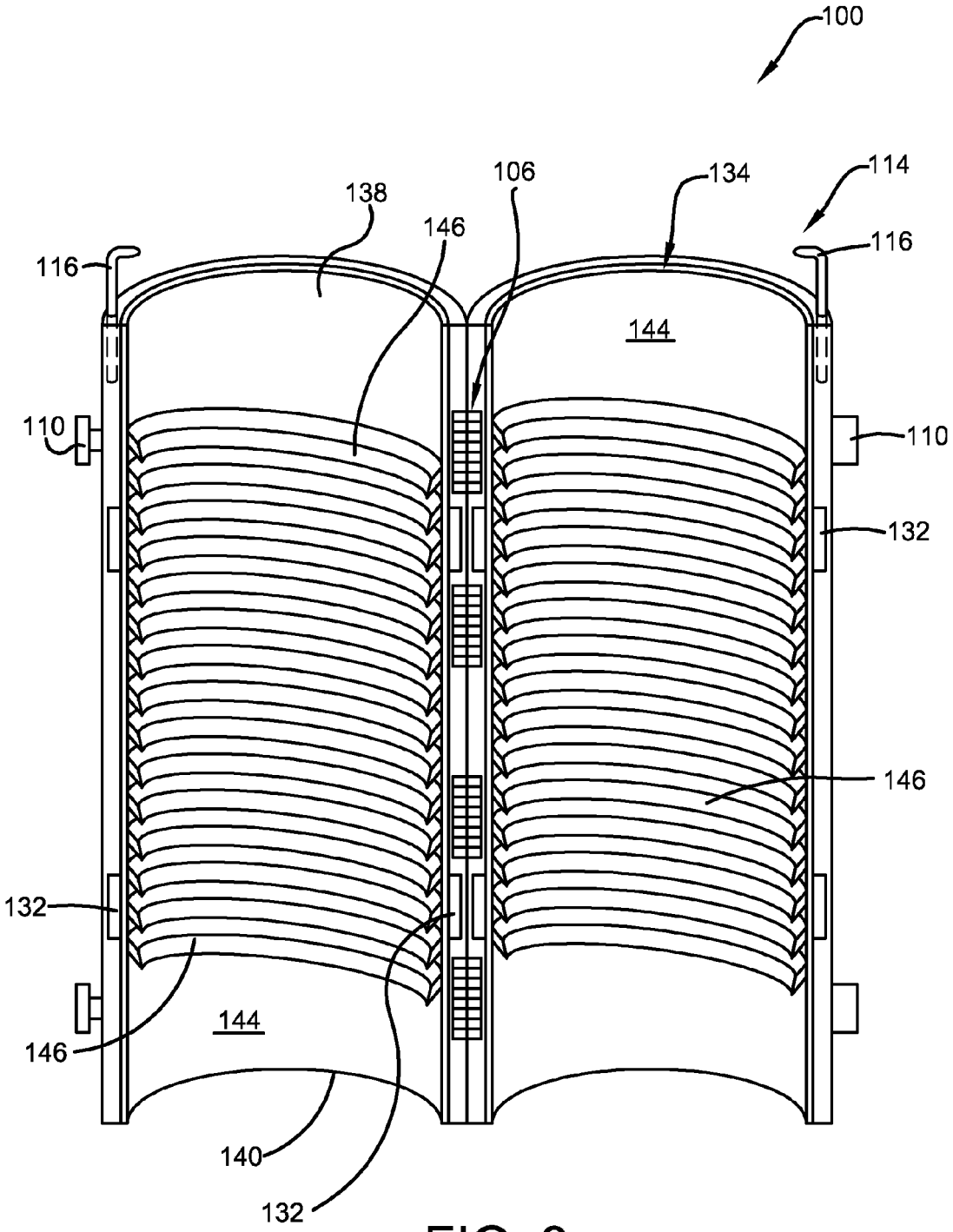
FIG. 3 illustrates a perspective view of the device for maintaining the lock of hair in an open position in accordance with the disclosed architecture.
Figure 4:
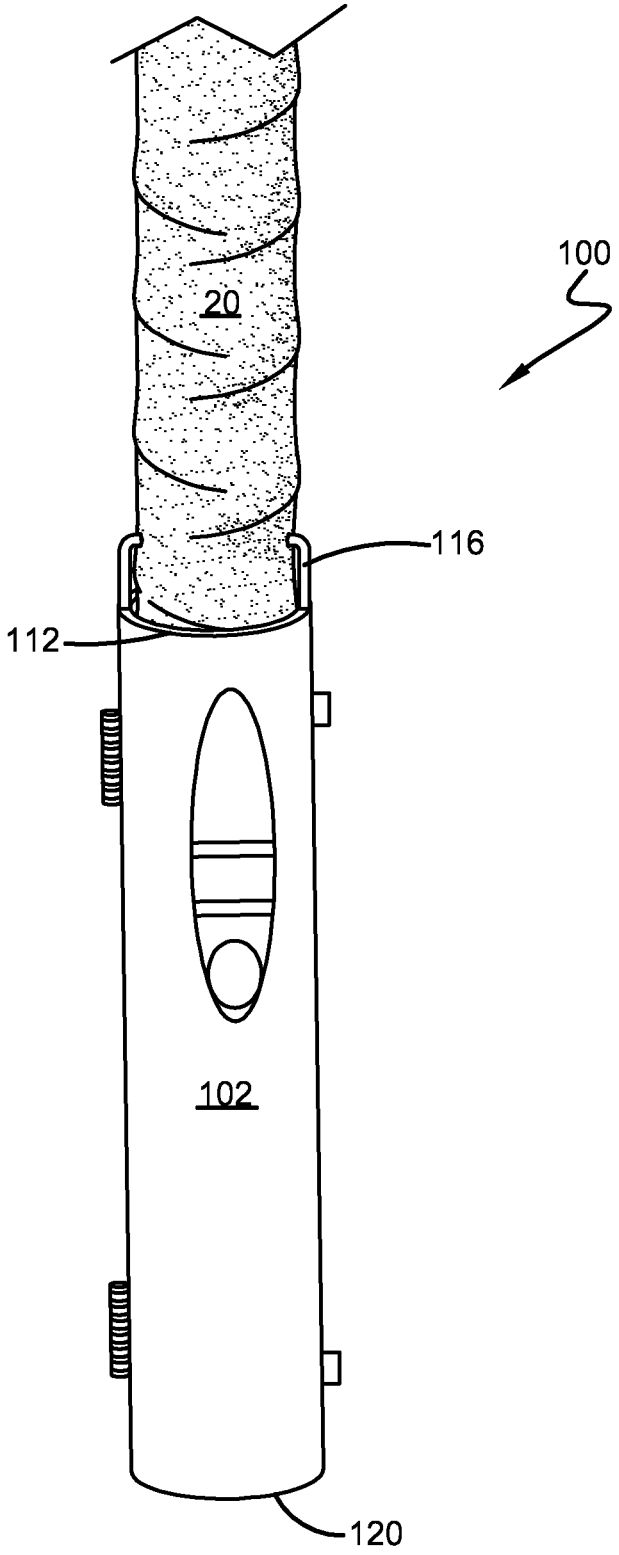
FIG. 4 illustrates a perspective view of the device for maintaining the lock of hair engaging the lock of hair in accordance with the disclosed architecture.

The housing 102 is substantially hollow and is bisected along a length 104 of the housing 102 so that the housing 102 may open and close. The housing 102 comprises a hinge 106 along the length 104 and attachment points 110 to hold the device 100 in a closed position as illustrated in FIG. 2. In the closed position, the device 100 substantially encapsulates the lock of hair 20 as illustrated in FIG. 4. FIG. 3 illustrates the device 100 in an open position for receiving the lock of hair 20.

The housing 102 further comprises a first end 112, a clamping mechanism 114, and a second end 120. When surrounding the lock of hair 20, the housing 102 is oriented so that the first end 112 is proximal and the second end 120 is distal to a scalp of a user. The clamping mechanism 114 comprises a plurality of securing components 116. The plurality of securing components 116 are typically L-shaped clips, catches, hooks, hooks with barbs, and the like, or any other fastener known to one of skill in the art. Any barbs are preferably blunted so that they may engage the lock of hair 20 without the risk of a puncture injury. The plurality of securing components 116 may be coated with a low friction coating such as a thermoplastic polymer, a fluoropolymer such as TEFLON®, or any other low coefficient of friction material known to one of skill in the art. Additionally, the clamping mechanism 114 retractably extends out of the first end 112 approximately at least ¼ inches Each hook is situated within the housing 102 and may be spring loaded.

To engage the lock of hair 20, the user activates the controller element 128 and the hooks extend out of the first end 112 of the housing 102. The hooks penetrate into the lock of hair 20 to prevent rotation of the housing 102 relative to the lock of hair 20. The grooming element 134 is then free to tighten the lock of hair 20 distal to the clamping mechanism 114 as discussed infra.

The motor 122 for spinning the grooming element 134 is encased within the housing 102. The motor 122 is typically powered by a disposable battery 124 also encased within the housing 102. However, the inventor contemplates alternative power sources, such as but not limited to a rechargeable battery or an electrical cord as part of the invention as well. The controller element 128 comprises a plurality of controls 130 in electrical communication with the motor 122. The plurality of controls 130 are switches, buttons, knobs, or the like that allow the motor 122 to operate the clamping mechanism 114 and/or the grooming element 134. The plurality of controls 130 may control the following functions: spin, start rotation, stop rotation, open, close, engage, release, and the like, or any other control needs of the device 100.

Once the device 100 is in place, the grooming element 134 may frictionally engage the lock of hair 20. The grooming element 134 is located within the housing 102 and rotatably engages an interior of the housing 102. The device 100 may further comprise a bearing element 132 or similar rotating mechanism such as but not limited to rotating rivets, coils, springs, and the like so that the grooming element 134 may rotate within the housing. The grooming element 134 is in electrical communication with the motor 122 so that when the controller element 128 activates the motor 122, the grooming element 134 will rotate and twist the lock of hair 20.

The grooming element 134 comprises a first end 138, a second end 140 and an inner circumference 144. Additionally, the grooming element 134 is bisected in a similar manner as the housing 102. Additionally like the housing 102, the first end 138 of the grooming element 134 when in place around the lock of hair 20 is oriented so that the first end 138 of the grooming element 134 is proximal and the second end 140 of the grooming element 134 is distal to the scalp of a user. Therefore, the first end 138 of the grooming element 134 will engage the lock of hair 20 closer to the scalp.

The grooming element 134 further comprises a plurality of trimming components 146. While the plurality of trimming components 146 are typically razor blades, it is contemplated that the plurality of trimming components 146 may comprise any similar trimming blade or knife as is known to one of skill in the art without affecting the overall scope of the invention. The plurality of trimming components 146 are embedded within or otherwise attached to the inner circumference 144 of the grooming element 134. The plurality of trimming components 146 are angled away from the first end 138 of the grooming element 134 downward toward the second end 140 of the grooming element 134. Additionally, the plurality of trimming components 146 are centrally located along the inner circumference, but do not extend past approximately one inch of the first end 138 and one inch of the second end 140. In other words, approximately one inch inward from the first end 138 and one inch inward from the second end 140 will not comprise any of the plurality of trimming components 146 The plurality of trimming components 146 are used to trim any fly away hair that would not re-twist into the lock of hair 20 following rotation of the grooming element 134.

Figure 5:
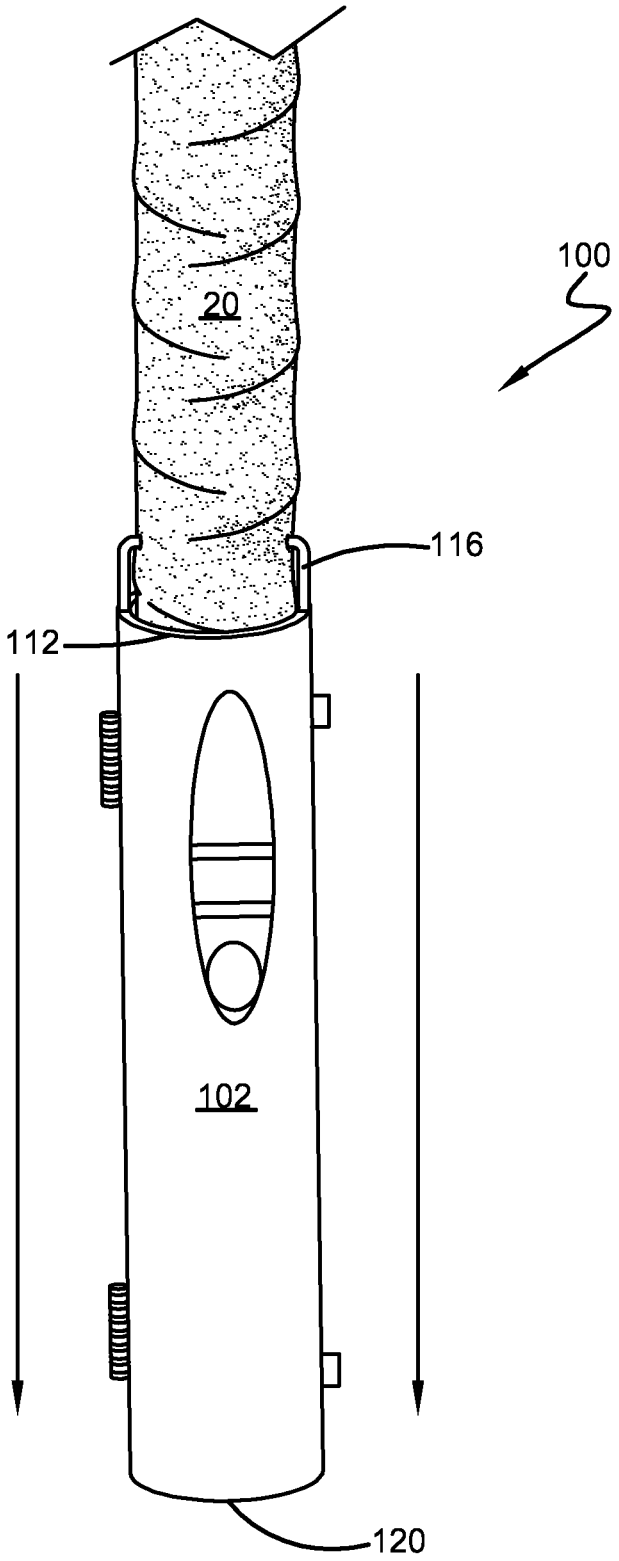
FIG. 5 illustrates a perspective view of the device for maintaining the lock of hair in accordance with the disclosed architecture.

To use the device 100, the user opens the housing 102 and places the lock of hair 20 inside. The housing 102 is then closed and the clamping mechanism 114 is engaged to secure the device 100 to the lock of hair 20. Next, the grooming element 134 is activated to rotate several rotations frictionally engaging the lock of hair 20 and re-twisting new growth into the lock of hair 20. Once the lock of hair 20 is re-twisted, the clamping mechanism 114 is released. Finally, as illustrated in FIG. 5, the user slides the device 100 along the lock of hair 20 away from the scalp allowing the plurality of trimming components 146 to trim off any hair that would not re-twist into the lock of hair 20.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for maintaining a lock of hair comprising:

a housing bisected and hinged along a length, the housing comprising a clamping mechanism for engaging the lock of hair; and a motor encased within the housing;

a controller element attached to the housing in electrical communication with the motor; and a grooming element in electrical communication with the motor rotatably secured to an interior of the housing for twisting the lock of hair, wherein the grooming element comprises an inner circumference and a plurality of trimming components attached to the inner circumference.

2. The device of claim 1, wherein the clamping mechanism comprises a plurality of retractable hooks.

3. The device of claim 2, wherein the plurality of retractable hooks are barbed.

4. The device of claim 2, wherein the plurality of retractable hooks are coated with a low friction coating.

5. The device of claim 1, wherein the plurality of trimming components are embedded within the inner circumference of the grooming element.

6. The device of claim 1, wherein the controller element comprises a plurality of controls for operating the clamping mechanism and rotating the grooming element.

7. A device for maintaining a lock of hair comprising:

a housing bisected and hinged along a length, the housing comprising a retractable clamping mechanism for engaging the lock of hair; and a motor encased within the housing;

a controller element attached to the housing in electrical communication with the motor; and a grooming element in electrical communication with the motor rotatably secured to an interior of the housing for twisting the lock of hair, wherein the grooming element comprises an inner circumference and a plurality of trimming components embedded within the inner circumference for trimming the lock of hair.

8. The device of claim 7, wherein the grooming element comprises a first end for engaging the lock of hair closer to a scalp of a user and a second end distal to the first end.

9. The device of claim 8, wherein the plurality of trimming components are razor blades.

10. The device of claim 9, wherein the razor blades are angled toward the second end of the grooming element.

11. The device of claim 10, wherein the razor blades are embedded within the inner circumference of the grooming element approximately between one inch of the first end and one inch of the second end.

12. The device of claim 11, wherein the clamping mechanism comprises a plurality of retractable hooks.

13. The device of claim 12, wherein the controller element comprises a plurality of controls for operating the clamping mechanism and rotating the grooming element.

* * * * *